US007175580B2

(12) United States Patent
Wolff et al.

(10) Patent No.: US 7,175,580 B2
(45) Date of Patent: Feb. 13, 2007

(54) WEAR INDICATOR FOR A ROLLER

(75) Inventors: Stephan Wolff, Glinde (DE); Stephan Peters, Schenefeld (DE); Harald Dittombee, Lüneburg (DE); Jürgen Pehmöller, Lauenburg (DE); Thomas Meins, Hamburg (DE); Volker Fricke, Buchholz (DE); Peter-Franz Arnold, Hamburg (DE); Sönke Horn, Geesthacht (DE); Joachim Glogasa, Geesthacht (DE); Jens Moje, Hamburg (DE)

(73) Assignee: Hauni Maschinenbau AG, Hamburg (DE)

( * ) Notice: Subject to any disclaimer, the term of this patent is extended or adjusted under 35 U.S.C. 154(b) by 447 days.

(21) Appl. No.: 10/337,405

(22) Filed: Jan. 7, 2003

(65) Prior Publication Data

US 2004/0149295 A1 Aug. 5, 2004

(30) Foreign Application Priority Data

Jan. 7, 2002 (DE) ..... 102 00 325

(51) Int. Cl.
*B05C 1/08* (2006.01)

(52) U.S. Cl. ..... 492/9; 492/10; 492/11

(58) Field of Classification Search ..... 492/9, 492/10, 11; 131/111
See application file for complete search history.

(56) References Cited

U.S. PATENT DOCUMENTS

| | | | | |
|---|---|---|---|---|
| 3,317,965 | A | 5/1967 | Murakami | |
| 5,428,437 | A * | 6/1995 | Carter et al. | 399/18 |
| 6,055,047 | A | 4/2000 | Schweizer et al. | |
| 6,092,032 | A * | 7/2000 | Hirayama | 702/115 |
| 6,393,226 | B1 * | 5/2002 | Charlebois et al. | 399/12 |
| 2002/0073866 | A1 * | 6/2002 | Bechtler et al. | 101/483 |

FOREIGN PATENT DOCUMENTS

| | | | | |
|---|---|---|---|---|
| CN | 1108072 | A | 9/1995 | |
| EP | 0 654 224 | B1 | 5/1995 | |
| JP | 6-65887 | * | 3/1994 | 492/9 |

* cited by examiner

*Primary Examiner*—Marc Jimenez
(74) *Attorney, Agent, or Firm*—Venable LLP; Robert Kinberg; Catherine M. Voorhees

(57) ABSTRACT

A roller for a device for processing a filter material ribbon in the tobacco-processing industry. The roller comprises a roller core and a covering for the roller core. The roller has at least one wear indicator operatively arranged for indicating wear of the covering.

5 Claims, 2 Drawing Sheets

WEAR INDICATOR FOR A ROLLER

CROSS-REFERENCE TO RELATED APPLICATION

This application claims the priority of German Patent Application No. 102 00 325.4 filed Jan. 7, 2002, the disclosure of which is incorporated herein by reference.

BACKGROUND OF THE INVENTION

The invention concerns a roller used in a device for processing a filter material ribbon in the tobacco-processing industry, the roller including a roller core and a covering for the roller core. The invention further concerns the use of such a roller. In addition, the invention concerns a device and a method for processing at least one filter material ribbon in the tobacco-processing industry with at least one roller having a roller core and at least one covering for the roller core.

A device of this type is disclosed in European Patent document No. EP 654 224 B1. For the production of filter rods in the tobacco-processing industry, a filter-material ribbon, the so-called filter tow, of a composite fiber material such as cellulose acetate is continuously pulled from a supply, for example a bale. The tow is then spread out, is stretched and sprayed with a solvent, for example triacetin, is subsequently gathered on the side, conveyed to a blast air nozzle and then supplied to a funnel. The processed and compacted filter tow is supplied from there to a filter strand-forming machine. In the filter strand-forming machine, the ribbon that is shaped into a filter strand is continuously enveloped with an enveloping material tape and is compacted further. The filter rods are subsequently cut from the enveloped filter strand.

Known processing devices of the above-described type are manufactured and sold by the assignee of the present application under the designation AF 1, AF 2 and AF 3. Further, known filter strand-forming machines of the above-described type are manufactured and sold by the assignee of the present application under the designation KDF 2 and KDF 3.

In the filter-processing device, the filter tow is transported, stretched and gathered with the aid of roller pairs. In the process, the filter tow is guided between the contacting rollers of a roller pair. In general, one roller of the pair of rollers is provided with a rigid, grooved surface, which makes contact with a resilient, rubbery surface and/or covering on the other roller. During the filter strand production, these rubber-covered rollers are subjected to a gradual, hardly noticeable wear of the covering. However, the roller covering wear clearly affects the filter quality after a specified production interval because the filter tow can no longer be transported and gathered to the required and desired degree.

SUMMARY OF THE INVENTION

It is an object of the present invention to monitor and ensure quality during the production of filter rods and/or filter strands, wherein the process of quality assurance and monitoring should be easy and low cost.

The above and other objects are achieved according to the invention by the provision of a roller for a device for processing a filter material ribbon in the tobacco-processing industry, comprising: a roller core; a covering for the roller core; and at least one wear indicator operatively arranged for indicating wear of the covering.

By indicating the wear, operators are warned early that the covering surface is strongly abraded or worn off and that the roller must be replaced. Once the roller has been replaced with a new roller, the filter-strand production process can continue.

The roller covering advantageously includes at least two layers, particularly in the roller regions which are subjected to heavy wear. The roller can be replaced, for example, if one or more wear layers or use layers are worn down because the wear on these layers is indicated.

According to one embodiment of the invention, the layers are different and/or distinguishable, wherein the differences and/or distinguishing features relate to the layer characteristics. For example, the layers can consist of different materials or have a different composition, which may not be optically discernable when viewing the roller. In contrast, distinguishable layers can also consist of the same material. By forming several different layers, for example, it is possible to produce a harder core covering and a softer use covering for the roller. Depending on the degree of use of the roller, a suitable wear-resistant covering can thus be produced. A somewhat harder covering mixture can be formed in particular in the regions of high wear.

The layers of one alternative embodiment of the invention can differ and/or become distinguishable as a result of wear on the covering. For example, it may not be possible to distinguish between the layers when the roller is originally installed. However, the covering and/or the layers are worn down during the operation, such that any wear becomes visible and is indicated. The wear on the covering caused by the filter strand production process can be detected easily as a result of the changes occurring in the roller layers.

It is preferable if the layers are optically different and/or can be optically distinguished. Being able to detect wear optically allows the operating personnel to recognize easily and quickly if a roller is worn out and must be replaced. Using different colors for the layers makes it easy to optically differentiate between the layers. For example, if a blue covering over the outer roller layer is worn down or worn off during the process of conveying the filter tow during the production, then the layer underneath, which may be red, is gradually exposed. Thus, the roller on the whole assumes a different color and indicates to the operating personnel an urgent need for replacing the roller. In addition, having several layers of different colors makes it possible to detect those regions on the roller, which are particularly subject to wear. If the covering surface becomes uneven, for example, the uneven roller can be refaced, so that it always has an even roller surface for the filter tow transport.

According to another embodiment of the invention, the layers are provided with at least one wear coating. A new wear coating can be applied to the roller once the original coating is worn off, thus resulting in a reduction of costs since only a replacement wear coating must be affixed to or arranged on the roller.

According to another aspect of the invention, there is provided a method of using a roller of the aforementioned type in a device for processing filter tow. By replacing the old rollers with rollers according to the invention, the production costs can be reduced since only the rollers must be replaced in the existing device.

According to still another aspect of the invention, there is provided a device for processing filter tow which utilizes a roller and a wear indicator is provided for measuring wear on the roller covering or the roller. Whereas the first embodiment according to the invention represents a type of "passive" wear indicator, for example using different colors for the roller layers, the wear indicator for this device has an "active" design. In other words, no measures are taken on the roller itself, but an indicator is installed in the device, which monitors and/or detects any wear occurring on the roller covering. This active wear indicator according to the invention furthermore indicates to the operating personnel that the roller must be replaced once the roller and/or the roller layers reach a certain degree of wear.

In accordance with one preferred embodiment of the invention, the wear indicator takes the form of at least one measuring device installed adjacent the surface of the roller covering. The indicator according to the invention measures and indicates and/or monitors the evenness and/or unevenness of a roller surface. Alternatively, the sensor can also indicate and detect wear-related color changes in the roller covering.

It is furthermore preferable if the measuring device is provided with at least one sensor, in particular an acoustic and/or optical sensor. The sensor permits a non-contacting scanning and/or recording of the surface of the rotating roller. Acoustical and/or optical measuring methods and measuring devices have proven to be particularly suitable for this purpose.

It is further preferable if the sensor is adapted as a distance sensor.

The measuring device is furthermore advantageously connected to an evaluation device, in particular a computer unit. The evaluation unit can evaluate the distances detected between the roller surface and the sensor and can stop the device if specific threshold values are not met or surpassed. The measuring data can additionally be stored in a computer unit and can be displayed, for example on a display unit. The memory-programmed central machine control for the device, for example, can function as the computer unit.

According to another aspect of the invention there is provided a method for the wear on the roller covering.

According to one embodiment of the method, the distance between the at least one measuring device, for example the distance sensor, and the roller surface is detected and/or measured. Unevenness on the roller surface can be detected and indicated as a result of the distance measurements.

In addition, the distance can advantageously be detected acoustically and/or optically.

As an alternative, it is possible to detect wear optically on the covering if the color of the roller covering changes as a result of abrasion and/or wear. This can be achieved with a multi-layer covering, for example comprising layers with different colors.

The wear and/or the distance are preferably determined with the aid of an evaluation unit, particularly a computer unit.

BRIEF DESCRIPTION OF THE DRAWINGS

The invention is explained in the following with the aid of exemplary embodiments, but without limiting the general inventive idea.

DETAILED DESCRIPTION OF THE INVNETION

Figure 1:
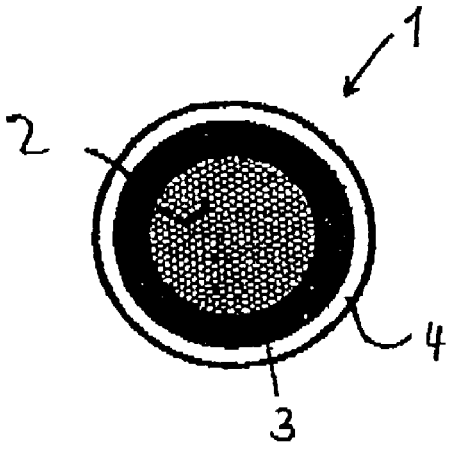
FIG. 1 is a cross-sectional view of a roller according to the invention.

In the Figures, the same elements are given the same reference numerals and will not be introduced again.

FIG. 1 shows a cross-sectional view of a roller 1 with roller core 2, which roller belongs to a pair of rollers. A roller 1 of this type is used together with another roller having a grooved surface in a filter-tow-processing device for conveying a filter tow.

The roller core 2 can be composed of steel and has a cylindrical shape. The roller core 2 is enclosed by a first layer 3, which is enclosed by another layer 4. The layers 3 and 4 have different colors and furthermore consist of rubber. As a result of wear on the outer layer 4, the diameter of roller 1 gradually decreases during the production process. Thus, following a specific production interval, the different-colored surface of layer 3 becomes visible. The layer 4 represents a type of wear coating and ensures an even high quality during the production process. When layer 4 is worn off, a reliable conveying of the filter tow can no longer be ensured. The change in color on the roller 1, for example, indicates to an operator that this roller must be replaced to ensure a reliable operation of the device.

Figure 2:
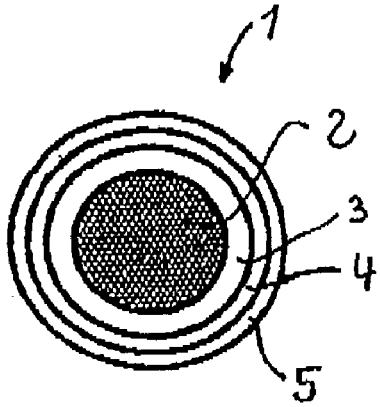
FIG. 2 is another cross-sectional view of a different roller according to the invention.

FIG. 2 shows an alternative embodiment of a roller 1 according to the invention, shown in a cross-sectional view. The roller core 2 of roller 1 in this case is provided with a total of three layers 3, 4, 5, which enclose the roller core 2 in the shape of a ring. The rubbery ring-shaped layers 3, 4, 5 have different colors, for example, thus optically indicating any uneven wear of the covering layers 3, 4, 5 during the use of roller 1.

During the filter production it has been found that the wear is higher in the center of roller 1 than along the edges of the roller because more filter tow material is conveyed in the center. The wear is hardly noticeable and creeping, but has a strong effect on the filter quality. The degree of wear and the location of the wear on the layers 3, 4, 5 can be assessed easier if the layers on the surface of roller 1 have different colors. The colors permit a quick detection of the wear. A roller with uneven surface can be refaced, thereby again creating an outer layer with uniform color for the refaced roller 1. Subsequently, the roller 1 can be reinstalled in the device.

Figure 3:
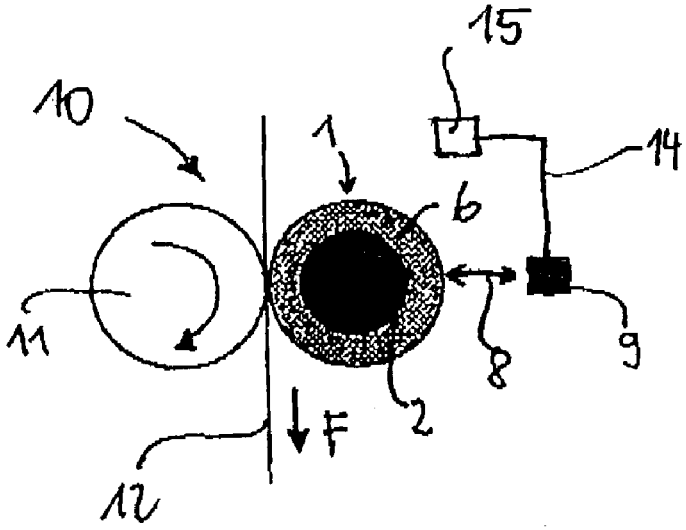
FIG. 3 is a partial block diagram showing a measuring device for use with rollers according to the invention.

FIG. 3 shows a roller pair 10, for example as described in the filter-tow processing device as disclosed in the above mentioned European patent document EP 654 224 B1. The roller pair 10, consisting of a roller 11 with a rigid, grooved surface and a roller 1 with a resilient surface such as rubber, is used in a stretching device, for example, or in an application section or a gathering section.

A ribbon consisting of filter tow 12 is conveyed between roller 11 and roller 1 in the conveying direction F indicated by arrow. A locally fixed sensor 9 that is assigned to the roller 1 measures a distance 8 between the covering 6 of roller core 2 and the sensor 9. The sensor 9 is connected via a connection 14 to a computer 15 for evaluating the distance-measuring signal. The distance between roller 1 and sensor 9 can be monitored and detected continuously, meaning on-line.

One exemplary embodiment, not shown herein, uses several sensors 9 that are arranged side-by-side and at a distance to each other along the roller 1 and are connected to the computer 15. With this device, for example, the total wear and the uneven wear on the roller 1 and/or the covering 6 can be measured by using at least three sensors. Through evaluating the measuring data, previously determined limit values can then be used for the monitoring.

The signal from the distance sensors 9 can additionally be utilized for a winding control of the filter-tow ribbon if the tow winds itself around the roller 1 and/or 11. If this is detected, the production process can be stopped automatically.

Figure 4B:
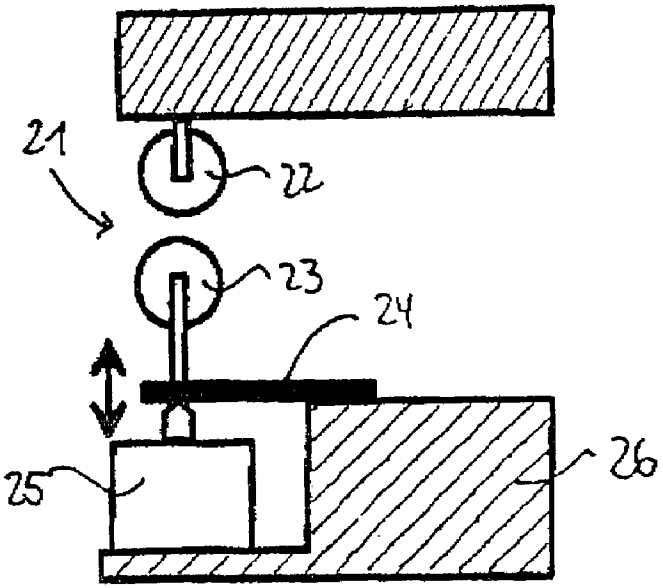
FIGS. 4*a* and 4*b* show a roller pair in a view from above (FIG. 4*a*) and in a view from the side (FIG. 4*b*).
Figure 4A:
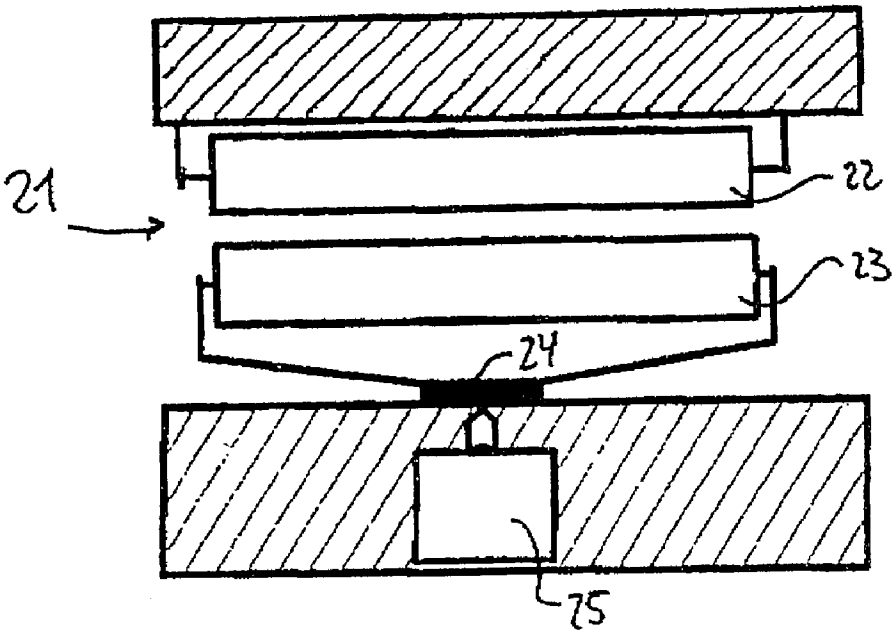

FIGS. 4*a* and 4*b* show a roller pair 21 in a pre-stretching section, in a view from above (FIG. 4*a*) and a view from the side (FIG. 4*b*). A roller pair 21 in a pre-stretching section is known, for example, from EP 654 224 B1.

The roller pair 21 of the pre-stretching section consists of a locally fixed roller 22 and a pre-stretching roller 23 that can be pivoted against the other roller. The pre-stretching roller 23 is positioned pivoting with the aid of a leaf spring 24, one end of which is arranged on a machine part 26. The roller is positioned with the aid of a holding shackle at the other end of the leaf spring 24. The leaf spring 24 functions as a two-dimensional bearing element and permits the roller 23 to be pivoted against the roller 22. At the end of the leaf spring 24, a pressure cylinder 25 is provided below the roller 23 to push the roller 23 against the roller 22. As a result of the leaf spring 24 and the pressure cylinder 25, very low frictional resistances are generated, so that an extremely precise and accurate control of the contact pressure between roller 23 and roller 22 is possible.

In addition, the leaf spring 24 is not subjected to bearing wear, so that the pivoting function and thus the product quality of the filter rods is not reduced even after a longer period of operation. Furthermore and in contrast to the spring bearings used so far, frictional corrosion that can develop even with very small movements is avoided.

It will be understood that the above description of the present invention is susceptible to various modifications, changes and adaptations, and the same are intended to be comprehended within the meaning and range of equivalents of the appended claims.

What is claimed is:

1. A device for processing at least one filter material ribbon in the tobacco-processing industry, comprising:

at least one roller for conveying the at least one filter ribbon in the tobacco-processing industry, said at least one roller including a roller core, at least one covering for the roller core and a wear indicator operatively arranged for indicating wear of the covering of the roller core wherein the wear indicator includes at least one distance sensor positioned outside the roller and roller core and arranged a distance from the surface of the covering for measuring the wear amount of the covering of the roller core due to the conveying of the at least one filter ribbon in the tobacco-processing industry.

2. The device according to claim 1, wherein the distance sensor comprises a measuring device.

3. The device according to claim 2, wherein the measuring device comprises at least one of an acoustic device and an optical device.

4. The device according to claim 2, further including an evaluation unit coupled to an output of the measuring device.

5. The device according to claim 4, wherein the evaluation unit comprises a computer unit.

* * * * *